US006322961B1

(12) United States Patent
Lam et al.

(10) Patent No.: US 6,322,961 B1
(45) Date of Patent: Nov. 27, 2001

(54) COLOR REVERSAL PHOTOGRAPHIC ELEMENT CONTAINING EMULSION SENSITIZED WITH ORGANOMERCAPTO AU(1) COMPLEXES AND RAPID SULFIDING AGENTS

(75) Inventors: Wai K. Lam, Webster; Roger Lok; David W. Sandford, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/666,268

(22) Filed: Sep. 21, 2000

(51) Int. Cl.[7] ..... G03C 1/06

(52) U.S. Cl. ..... 430/603; 430/605; 430/599; 430/567; 430/569

(58) Field of Search ..... 430/567, 569, 430/599, 603, 605

(56) References Cited

U.S. PATENT DOCUMENTS

| | | | | |
|---|---|---|---|---|
| 4,810,626 | | 3/1989 | Burgmaier et al. . | |
| 5,210,002 | * | 5/1993 | Adin | 430/605 |
| 5,641,621 | * | 6/1997 | Hahm et al. | 430/569 |
| 5,759,760 | * | 6/1998 | Lushington et al. | 430/603 |
| 5,759,761 | * | 6/1998 | Lushington et al. | 430/605 |
| 5,912,111 | * | 6/1999 | Lok et al. | 430/603 |
| 5,912,112 | | 6/1999 | Lok et al. . | |
| 5,939,245 | * | 8/1999 | Lok et al. | 430/605 |
| 5,945,270 | | 8/1999 | Lok et al. . | |
| 6,034,249 | | 3/2000 | Lok et al. . | |
| 6,159,676 | | 12/2000 | Lin et al. . | |

* cited by examiner

*Primary Examiner*—Geraldine Letscher
(74) *Attorney, Agent, or Firm*—Andrew J. Anderson

(57) ABSTRACT

A color reversal photographic element is disclosed comprising a support having coated thereon a silver halide emulsion layer comprising a silver halide emulsion chemically sensitized in the presence of an organomercapto Au(I) complex having the formula

[L—Au—L]M wherein M is a cationic counter ion and each L is an organomercapto ligand which has antifogging, stabilizing or sensitizing properties, and a rapid sulfiding agent represented by structure SS-1

SS-1 wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain. The use of the combination of the two classes of sensitizers of the present invention makes it possible to sensitize the silver halide emulsions employed in color reversal elements at a wider range of temperature. This robustness to temperature translates to less variable performance of the silver halide emulsion. Additionally, the use of individual gold and sulfur sensitizers advantageously makes it possible to sensitize silver halide reversal photographic elements such that the sulfur to gold ratio can be varied independently.

20 Claims, No Drawings

COLOR REVERSAL PHOTOGRAPHIC ELEMENT CONTAINING EMULSION SENSITIZED WITH ORGANOMERCAPTO AU(1) COMPLEXES AND RAPID SULFIDING AGENTS

FIELD OF THE INVENTION

This invention relates to a color reversal photographic element containing an emulsion sensitized with an organomercapto Au(I) complex and a rapid sulfiding agent. It further relates to a method of sensitizing color reversal silver halide emulsions with such organomercapto Au(I) complexes and rapid sulfiding agents.

BACKGROUND OF THE INVENTION

There has been considerable effort devoted to improving the sensitivity of silver halide crystals to actinic radiation and thereby increasing the sensitivity of the photographic elements in which they are contained. In this regard, photographic chemists have attempted to vary the components of, or the processes for making, silver halide emulsions. One particularly preferred means to improve sensitivity has been to chemically sensitize photographic emulsions with one or more compounds containing labile atoms of gold, sulfur, selenium or the like. Examples of chemically sensitized photographic silver halide emulsion layers are described in, for example, *Research Disclosure,* Item No. 308119, December 1989, Section III, and the references listed therein. (*Research Disclosure* is published by Kenneth Mason Publications Ltd, Dudley Annex, 12a North Street, Emsworth, Hampshire PO 10 7DQ, England.)

Many gold sensitizers have been described. For example, U.S. Pat. No. 3,503,749 describes the use of water soluble Au(I) thiolate salts comprising one Au atom ligated to one sulfur containing ligand; U.S. Pat. No. 5,220,030 teaches the use of Au(I) compounds with bis mesoionic heterocycles; U.S. Pat. No. 5,252,455 and U.S. Pat. No. 5,391,727 disclose the use of Au(I) macrocyclic cationic sensitizers; U.S. Pat. No. 5,049,484 teaches the use of Au(I) sensitizers having a Au atom ligated to the nitrogen atom of heterocyclic rings. U.S. Pat. No. 5,620,841 discloses the use of gelatin dispersions of a Au(I) thiosulfonato sensitizer with two different ligands at least one of which is mesoionic; and U.S. Pat. No. 5,700,631 teaches the use of gelatin dispersions of Au(I) thiosulfonato sensitizers with two different ligands at least one of which is a thioether group. JP 8069075 discusses the use of organic gold sulfide compounds in the sensitization to give low fogging and high contrast silver halide photographic materials. However, all of the above compounds have one or more disadvantages such as lack of water solubility, difficulty of synthesis or poor stability.

One common chemical sensitizer used in the sensitization of silver halide emulsions is aurous sulfide, which is made as a colloidal gelatin dispersion, the exact composition of which is not well characterized. This gold sulfide dispersion can give rise to lot-to-lot variability and undesirable and inconsistent sensitometric performance. The source of this variability may come from side reactions in the preparation of this highly insoluble solid since these reactions produce species which may be photographically active. Further, because of the highly insoluble nature of gold sulfide, most of the sensitizer added is in fact unused during the sensitization. The remaining sensitizer left in the gel/silver halide matrix can affect sensitometry.

The bis Au(I) mesoionic heterocycles, e.g. bis(1,4,5-trimethyl-1,2,4-triazolium-3-thiolate) gold (I) tetrafluoroborate, while being very useful sensitizers, are somewhat lacking in solution stability. Further, for the mesoionic triazolium sensitizers, multiple steps and recrystallizations are required in the preparation of the starting material bis(tetramethylthiourea) Au(I) tetrafluoroborate. Synthesis of the gold ligand 1,4,5-trimethyl-1,2,4-triazolium-3-thiolate is difficult, and the preparation of the mesoionic triazolium sensitizer is limited to small batches. Finally, the limited solubility of the mesoionic triazolium sensitizers requires the use of a large volume of water for dissolution.

Aurous dithiosulfate, $Au(I)(SSO_3)_2$, a gold sensitizer that is water soluble, has its limitations for sensitization. One of the limitation is that aurous dithiosulfate contains a labile sulfur atom which also sulfur sensitizes the silver halide photographic emulsion. Further, because of the sulfur and gold composition of the chemical, the gold to sulfur sensitization ratio is always limited to 1:2. Thus it would not be possible to use this sensitizer alone for a gold only sensitization or for any other sensitization where the ratio of gold to sulfur desired is different from 1:2.

U.S. Pat. Nos. 5,912,112, 5,945,270 and 6,034,249 describe Au(I) complexes comprising organomercapto ligands. U.S. Pat. Nos. 5,945,270 and 6,034,249 in particular describe water soluble symmetrical bis organomercapto Au(I) complexes which provide numerous advantages. They are highly effective sensitizers for silver halide emulsions. They are also highly water soluble. Because of the water solubility of these complexes, the use of costly and time consuming preparation of gel dispersions is unnecessary. Further, there is no need to use large volumes of water for dissolving the complexes. Additionally, they are easily manufactured from readily available starting materials. Use of such organomercapto gold complexes with common sulfur sources such as thiosulfate in the chemical sensitization of silver halide emulsions employed in color reversal elements, however, has also been found to result in an undesirable speed variability dependent upon sensitization temperatures.

In the art of chemical sensitization, it is known that the emulsion sensitivity and fog propensity are strongly dependent on the sensitization temperature. The use of higher temperature often leads to high fog. Lower temperature may result in lower sensitivity. Such variations in emulsion performance as a result of temperature variations not only leads to poor quality of emulsion performance, but can lead to waste and increase the cost of manufacturing high quality products. Thus, there is a need for sensitizing silver halide emulsions that have minimal variations due to temperature fluctuations during sensitization. Hence, it would be desirable to provide color reversal elements comprising emulsions chemically sensitized with organomercapto Au(I) complexes and a sulfur source, whereby a reduced sensitivity to temperature, known as finish robustness, is achieved.

SUMMARY OF THE INVENTION

This invention relates to a color reversal photographic element comprising a support and a silver halide emulsion layer comprising a silver halide emulsion chemically sensitized in the presence of an organomercapto Au(I) complex having the formula $$[L—Au—L]M$$

wherein M is a cationic counter ion and each L is an organomercapto ligand which has antifogging, stabilizing or sensitizing properties, and a rapid sulfiding agent represented by structure SS-1

SS-1

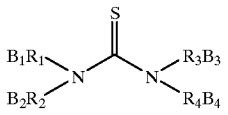

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain.

In preferred embodiments of the invention, each L group of the organomercapto Au(I) complex employed in the chemical sensitization of the silver halide emulsion represents the same ligand (i.e., the complex is symmetrical), and in particularly preferred embodiments the organomercapto Au(I) complex is a water soluble complex of the formula $$[(M\text{-}SOL)_n\text{-}A\text{—}S\text{—}Au\text{—}S\text{—}A\text{-}(SOL\text{-}M)_n]M$$

wherein M is a cationic counterion, SOL is a solubilizing group, A is a substituted or unsubstituted divalent organic linking group, and n is 1 to 4.

The use of the combination of the two classes of sensitizers of the present invention makes it possible to sensitize the silver halide emulsions employed in color reversal elements at a wider range of temperature. This robustness to temperature translates to less variable performance of the silver halide emulsion. Additionally, the use of individual gold and sulfur sensitizers advantageously makes it possible to sensitize silver halide reversal photographic elements such that the sulfur to gold ratio can be varied independently.

DETAILED DESCRIPTION OF THE INVENTION

Organomercapto Au(I) complexes useful in the invention may be represented by the formula $$[L\text{—}Au\text{—}L]M$$

wherein M is a cationic counter ion such as an alkali metal, for example potassium, sodium or cesium, or an ammonium cation, for example, a tetrabutyl or tetraethyl ammonium group, and each L is an organomercapto ligand which has antifogging, stabilizing or sensitizing properties and which is suitable for use in a silver halide photographic element. Many such ligands are known in the art and are either commercially available or may be prepared as described in Research Disclosure 274 (1984). Some suitable ligands include thiolic ligands having hydrophilic substituents such as mercaptoazoles, examples of which are contained in U.S. Pat. Nos. 3,266,897; 4,607,004; 3,266,897; 4,920,043; 4,912,026; 5,011,768 and U.K. Patent 1,275,701. In preferred embodiments, each L represents the same ligand (i.e., the complex is symmetrical), as such compounds are more easily manufactured.

The organomercapto Au(I) complexes useful in the invention may preferably be further represented by water soluble complexes of the formula $$[(M\text{-}SOL)_n\text{-}A\text{—}S\text{—}Au\text{—}S\text{—}A\text{-}(SOL\text{-}M)_n]M$$

wherein M is a cationic counterion as described above, A is a substituted or unsubstituted divalent organic radical, SOL is a water solubilizing group, suitable examples of which are sulfato, sulfonato, sulfinato, phosphato, and carboxy groups, and n is an integer from 1 to 4, more preferably 1 or 2. Again, the complex preferably is symmetrical.

Preferably A is an aliphatic (cyclic or acyclic), aromatic or heterocyclic divalent group. When A is an aliphatic group, preferably it is a substituted or unsubstituted aliphatic group having 1 to 20 carbon atoms, and more preferably having 1 to 8 carbon atoms. Examples of appropriate groups include alkylene groups such as ethylene, methylene, propylene, butylene, pentylene, hexylene, octylene, 2-ethylhexylene, decylene, dodecylene, hexadecylene, octadecylene, cyclohexylene, isopropylene and t-butylene groups. The preferred aromatic groups have from 6 to 20 carbon atoms. More preferably, the aromatic groups have 6 to 10 carbon atoms and include, among others, phenylene and naphthylene groups. These groups may have substituent groups. The heterocyclic groups are preferably substituted or unsubstituted divalent 3 to 15 membered rings with at least one atom selected from nitrogen, oxygen, sulfur, selenium and tellurium in the ring nucleus. More preferably, the heterocyclic groups are 5 to 6 membered rings with at least one atom, and preferably more than one atom, selected from nitrogen. Examples of heterocyclic groups include the divalent radicals of pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. The preferred heterocyclic group is tetrazole.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, andp-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. One particularly suitable substituent for A is a benzamido group.

Generally, the above groups and substituents thereof may include those having up to 48 carbon atoms, typically 1 to 36 carbon atoms and usually less than 24 carbon atoms, but greater numbers are possible depending on the particular substituents selected.

When A is substituted, $(SOL\text{-}M)_n$ may be attached to the substituent. In one suitable embodiment $A\text{-}(SOL\text{-}M)_n$ (wherein n is 1) is

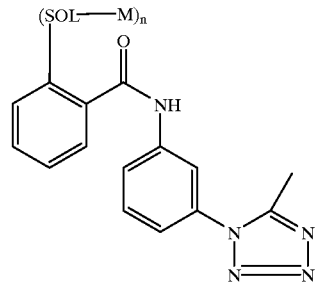

Specific examples of the organomercapto Au(I) complexes useful in the invention include, but are not limited to (A)

$NaAu—(SCH_2CO_2Na)_2$ (B)

$NaAu—(SCH_2CH_2CHOMeCH_2OPO_3Na)_2$ (C)

$NaAu—(SCH_2CHOHCH_2SO_3Na)_2$ (D)

$NaAu—(SCH_2CH_2SO_2Na)_2$ (E)

$KaAu—(SCHMeCHClCH_2CH_2SO_3K)_2$ (F)

$CsAu—(SCH_2CHCNCH_2CH_2PO_3Cs)_2$ (G)

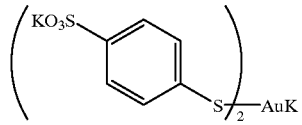

(H)

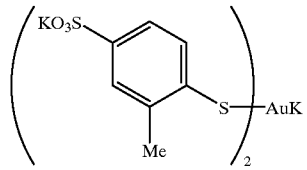

(I)

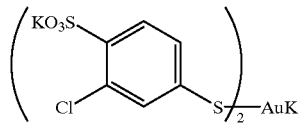

(J)

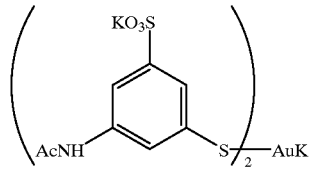

-continued (K)

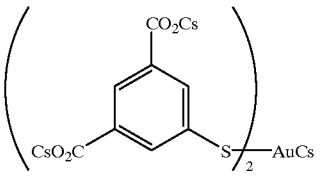

(L)

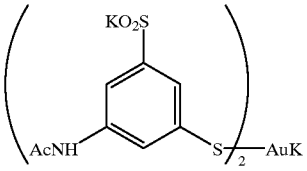

(M)

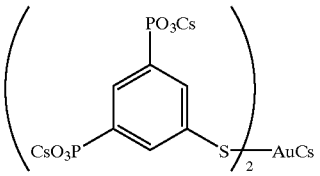

(N)

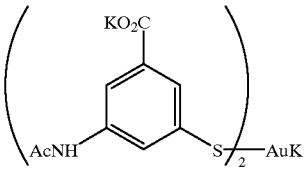

(O)

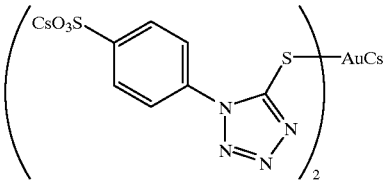

(P)

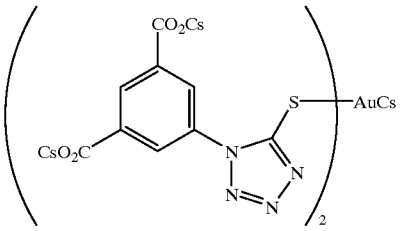

(Q)

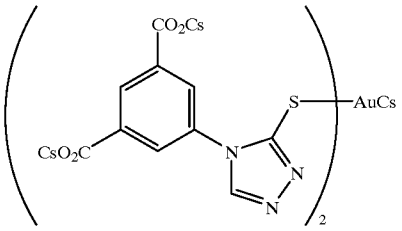

-continued (R)

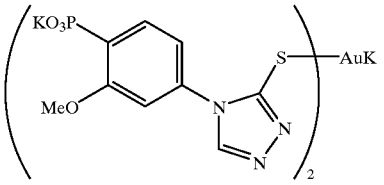

(S)

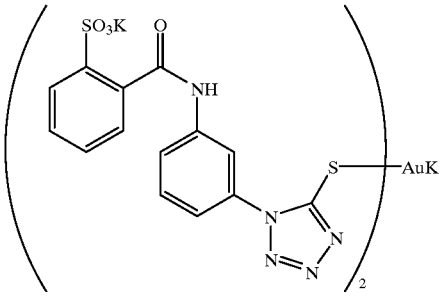

(T)

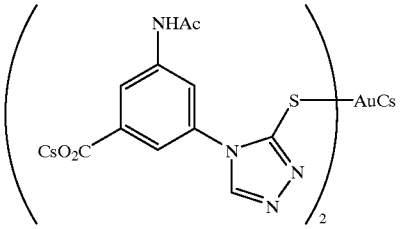

(U)

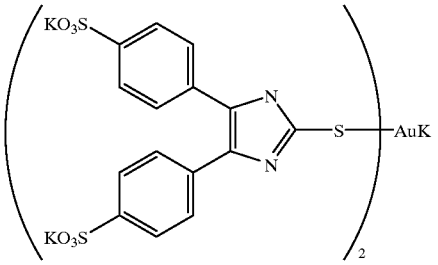

(V)

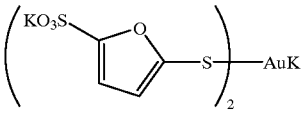

(X)

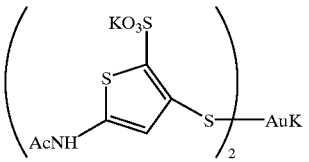

One particularly preferred suitable complex is Compound S, potassium bis(1-[3-(2-sulfonatobenzamido)phenyl]-5-mercaptotetrazole potassium salt) aurate(I) pentahydrate.

One of the advantages of the preferred organomercapto Au(I) complexes useful in this invention is their solubility in water. Preferably they have a solubility at 22° C. of at least 2 g/L, more preferably 5 g/L, and most preferably 10 g/L. Particularly suitable compounds have a solubility of greater than 20 g/L.

The organomercapto Au(I) complexes are manufactured by reacting an Au (I) complex with an organomercapto ligand and isolating the resulting organomercapto Au(I) complex from the reaction mixture. Suitable Au(I) complexes for use in this process are those having a more positive redox potential than the desired organomercapto Au(I) complex, thus allowing for the easy replacement of the ligand. Such compounds are known to those skilled in the art. Examples of some useful Au(I) complexes include $AuCl_2^-$, $AuBr_2^-$, $Au(MeS—CH_2—CH_2—CHNH_2COOH)_2^+$, $AU(C_3H_3N_2—CH_2—CH_2—NH_2)_2^+$, $Au(CNS)_2^-$, AuI, or $Au(NH_3)_2^+$, with AuI being particularly suitable. Isolation of the resulting organomercapto Au(I) complex from the reaction mixture by any suitable method, for example, by the treatment of the reaction mixture with several equivalents of an alkali halide or by the addition of a water miscible non-solvent. The solid Au(I) complex may be collected by filtration and dried in vacuo. The preferred method of isolation typically involves the introduction of an alkali halide followed by cooling of the reaction solution. The material is isolated by suction filtration and treated with chilled aqueous alcohol washes, such as butanol, isopropanol, ethanol. etc. The procedure is straightforward with no complicated operations or multiple recrystallizations. A more detailed description of the preparation and isolation of organomercapto Au(I) complexes can be found in U.S. Pat. Nos. 5,945,270 and 6,034,249, the disclosures of which are incorporated by reference.

The preferred organomercapto Au(I) complexes useful in the photographic elements of this invention have numerous advantages. They are highly effective sensitizers for silver halide emulsions. They are also highly water soluble. Because of the water solubility of these complexes, the use of costly and time consuming preparation of gel dispersions is unnecessary. Further, there is no need to use large volumes of water for dissolving the complexes.

Unlike prior mixed-ligand gold compounds, the two Au ligands in the complexes employed in preferred embodiments of this invention are identical, thus reducing the complexity of preparation. Further, the complexes utilize inexpensive and commercially available starting materials. Another advantage is that the preparation of the gold complexes useful in the present invention does not utilize dangerous explosive gold fulminates or large quantities of organic solvents. Additionally, because of the stability of the covalent gold and sulfur bonds, the complexes useful in the present invention are more stable than those having mesoionic ligands. Indeed, there is evidence that even in acidic solutions, the complexes useful in the present invention are more stable than those of the mesoionic sensitizers.

The organomercaptides used in the preparation of the Au(I) complexes may include the numerous thiolic antifoggants/stabilizers. Because of the sensitizing, antifogging, and stabilizing properties of these thiolic ligands, the Au(I) sensitizers derived from these ligands may also show speed enhancing and antifogging/stabilizing effects in addition to their sensitizing properties.

Rapid sulfiding agents useful in the present invention may be represented by structure SS-1

SS-1

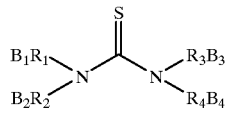

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain. Tetrasubstituted middle chalcogen ureas of such formula were first disclosed in U.S. Pat. No. 4,810,626, the disclosure of which is here incorporated by reference.

A preferred group of rapid sulfiding agents having the general SS-1 structure is that wherein each of the $R_1$, $R_2$, $R_3$, and $R_4$ groups independently represents an alkylene group having 1 to 6 carbon atoms; and each of the $B_1$, $B_2$, $B_3$, and $B_4$ groups independently is hydrogen or represents a carboxylic, sulfinic, sulfonic, hydroxamic group; with the proviso that at least one of the $B_1R_1$ to $B_4R_4$ groups contains the nucleophilic group bonded to a urea nitrogen atom through a 1- or 2-membered chain. Especially preferred ureas of this type are represented by structures SS-1a and SS-1b:

SS-1A

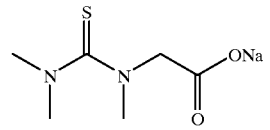

SS-1b

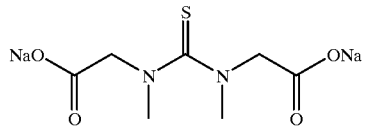

These compounds have been shown to be very effective sensitizers under mild digestion conditions and were shown to produce higher speeds than many other thiourea compounds that were lacking the specified nucleophilic substituents.

The photographic emulsions useful in this invention are generally prepared by precipitating silver halide crystals in a colloidal matrix by methods conventional in the art. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. The colloid is typically a hydrophilic film- forming agent such as gelatin, alginic acid, or derivatives thereof. The silver halide emulsions utilized in this invention may be comprised of any halide distribution.

Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions.

Preferably, the silver halide emulsions utilized in the color reversal elements of this invention are predominantly high bromide emulsions. By high bromide, it is meant that the grains of the emulsion are greater than about 50 mole percent silver bromide. Preferably, they are greater than about 80 mole percent silver bromide, and optimally greater than about 85 mole percent silver bromide. The iodide content of the high bromide grains can range up to saturation levels, e.g., up to approximately 40 mole percent, based on total silver, in a silver iodobromide composition. Preferably the iodide content is less than 20 mole percent and, most commonly less than 12 mole percent, based on total silver. Generally iodide concentrations as low as about 0.1 mole percent, based on total silver, produce demonstrable photographic performance advantages, with minimum iodide concentrations of at least 0.5 mole percent, based on total silver, being preferred for photographic performance advantages, such as an improved speed-granularity relationship, to be realized. Silver chloride can be present in the high bromide grains in concentrations of up to 50 mole percent. Preferred silver halide emulsions are iodobromide emulsions with an iodide content of 2 to 12%.

The emulsions employed in the elements of this invention can include silver halide grains of any conventional shape or size (e.g., cubical, octahedral, dodecahedral, spherical or tabular) of silver halide grains. Specifically, the emulsions can include coarse, medium or fine silver halide grains. It is preferred, however, that the present invention be practiced with tabular grains having an aspect ratio of at least 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an equal to the projected area of the grain. High aspect ratio tabular grain emulsions are specifically contemplated, such as those disclosed by Wilgus et al, U.S. Pat. No. 4,434,226, Daubendiek et al, U.S. Pat. No. 4,414,310, Wey, U.S. Pat. No. 4,399,215, Solberg et al, U.S. Pat. No. 4,433,048, Mignot, U.S. Pat. No. 4,386, 156, Evans et al, U.S. Pat. No. 4,504,570, Maskasky, U.S. Pat. No. 4,400,463, Wey et al, U.S. Pat. No. 4,414,306, Maskasky, U.S. Pat. Nos. 4,435,501 and 4,643,966 and Daubendiek et al, U.S. Pat. Nos. 4,672 and 4,693,964, all of which are incorporated herein by reference. Also, specifically contemplated are those silver iodobromide grains with a higher molar proportion of iodide in the core of the grain than in the periphery of the grain, such as those described in British Reference No. 1,027,146; U.S. Pat. Nos. 4,379,837; 4,444,877; 4,665,012; 4,686,178; 4,565,778; 4,728,602; 4,668,614 and 4,636,461 and in the European Reference No. 264,954, all of which are incorporated herein by reference. The silver halide emulsions can be either monodisperse or polydisperse as precipitated. The grain size distribution of the emulsions can be controlled by silver halide grain separation techniques or be blending silver halide emulsions of differing grain sizes.

A particularly useful application of the organomercapto Au(I) complexes and rapid sulfiding agent tetrasubstituted thioureas involves the sensitization of tabular grain emulsions comprising epitaxially deposited silver halide protrusions at the comers and edges of the host tabular emulsion (eg. Daubendiek et al U.S. Pat. Nos. 5,576,168 and 5,573,902; Olm et al U.S. Pat. Nos. 5,503,970 and 5,576,171; Deaton et al U.S. Pat. No. 5,582,965). Tabular grain emulsions without epitaxial deposition are also excellent substrates for treatment with organomercapto Au(I) complexes and tetrasubstituted thioureas (see, for example, Deaton, U.S. Pat. No. 5,049,485 and Lin et al, U.S. Pat. No. 6,159,676.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

The silver halide grain crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The general methods for precipitation and spectral and chemical sensitization utilized in preparing the emulsions employed in the invention can be those general methods known in the art.

The organomercapto Au(I) complexes and rapid sulfiding agents may be added to the silver halide emulsion at any time during the preparation of the emulsion, i.e., during precipitation, during or before chemical sensitization or during final melting and co-mixing of the emulsion and additives for coating. Preferably, the emulsion is chemically sensitized in the presence of the organomercapto Au(I) complexes and rapid sulfiding agents. More preferably, these compounds are added after precipitation of the grains, and most preferably they are added before or during the heat treatment of the chemical sensitization step.

The organomercapto Au(I) complexes and rapid sulfiding agents may be introduced into the emulsion at the appropriate time by any of the various techniques known to those skilled in the art. Preferably they are added as an aqueous solution to the emulsion. One suitable method includes preparing a silver halide emulsion by precipitating silver halide grains in an aqueous colloidal medium to form an emulsion, digesting (heating) the emulsion, preferably at a temperature in the range of 40 to 80° C., and adding to the emulsion, either before or during heating, an aqueous solution of the rapid sulfiding agents and the organomercapto Au(I) complex. The order of addition of the sulfur and gold sources in the examples herein is sulfur followed by gold but is not limited to this sequence.

Conditions for sensitizing silver halide grains such a pH, pAg, and temperature are not particularly limited. The pH is generally about 1 to 9, preferably about 3 to 6, and pAg is generally about 5 to 12, preferably from about 7 to 10.

The organomercapto Au(I) complexes and rapid sulfiding agents may also be added to the vessel containing the aqueous gelatin salt solution before the start of the precipitation; or to a salt solution during precipitation. Other modes are also contemplated. Temperature, stirring, addition rates and other precipitation factors may be set within conventional ranges, by means known in the art, so as to obtain the desired physical characteristics.

The organomercapto Au(I) complexes and rapid sulfiding agents may be used in addition to any conventional sensitizers as commonly practiced in the art. Combinations of more than one organomercapto Au(I) complex may be utilized. Additional conventional sensitizers which may be used include additional sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization.

Useful levels of the rapid sulfiding agents employed in the present invention may range from 0.03 $\mu$mol to 30,000 $\mu$mol per silver mole. Preferred range may be from 0.15 $\mu$mol to 3,000 $\mu$mol per silver mole. A more preferred range is from 0.3 $\mu$mol to 1500 $\mu$mol per silver mole. The most preferred range is from 3 $\mu$mol to 150 $\mu$mol/Ag mole.

Useful levels of Au(I) sensitizers employed in the present invention may range from 0.01 $\mu$mol to 10,000 $\mu$mol per silver mole. Preferred range may be from 0.05 $\mu$mol to 1,000 $\mu$mol per silver mole. A more preferred range is from 0.1 $\mu$mol to 500 $\mu$mol per silver mole. The most preferred range is from 1 $\mu$mol to 50 $\mu$mol/Ag mole.

Spectral sensitization is typically effected with a combination of dyes, which are designed for the wavelength range of interest within the visible or infrared spectrum. It is known to add such dyes both before and after heat treatment. The silver halide may be sensitized by sensitizing dyes by any method known in the art. Examples of dyes include dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating of the emulsion layers. Various coating techniques include dip coating, air knife coating, curtain coating and extrusion coating.

Photographic emulsions sensitized in accordance with the present invention may be incorporated into any color reversal photographic elements. Multicolor elements typically contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. Dye-forming couplers may be incorporated into the emulsion layers, or may be introduced during processing (e.g., with standard published K-14 Kodachrome processing).

A typical coupler-incorporated color reversal photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Each silver halide emulsion unit can be composed of one or more layers and the various units and layers can be arranged in different locations with respect to one another. The element may contain additional layers, such as filter layers, interlayers, overcoat layers, subbing layers, and the like. In a typical construction, a color reversal film is distinguished from a color negative film in that it does not have any masking couplers. Furthermore, reversal films have a gamma generally between −1.5 and −4.0, which is much higher than the gamma for typical negative materials.

In the following Table, reference will be made to (1) Research Disclosure, December 1978, Item 17643, (2) Research Disclosure, December 1989, Item 308119, (3) Research Disclosure, September 1994, Item 36544, and (4) Research Disclosure, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in Research Disclosure, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, morphology and |
| 2 | I, II, IX, X, XI, XII, XIV, XV | preparation. Emulsion preparation including hardeners, coating aids, |
| 3 & 4 | I, II, III, IX A & B | addenda, etc. |
| 1 | III, IV | Chemical sensitization and spectral |
| 2 | III, IV | sensitization/desensitization. |
| 3 & 4 | IV, V | |
| 1 | V | UV dyes, optical brighteners, |
| 2 | V | luminescent dyes. |
| 3 & 4 | VI | |
| 1 | VI | Antifoggants and stabilizers. |
| 2 | VI | |
| 3 & 4 | VII | |
| 1 | VIII | Absorbing and scattering materials, |
| 2 | VIII, XIII, XVI | Antistatic layers, Matting agents. |
| 3 & 4 | VIII, IX C & D | |
| 1 | VII | Image-couplers and image modifying |
| 2 | VII | couplers, Washout couplers, Dye stabilizers and hue modifiers. |
| 3 & 4 | X | |
| 1 | XVII | Supports |
| 2 | XVII | |
| 3 & 4 | XV | |
| 3 & 4 | XI | Specific layer arrangements. |
| 3 & 4 | XII, XIII | Negative working emulsions; Direct positive emulsions. |
| 2 | XVIII | Exposure. |
| 1 | XIX, XX | Chemical processing; |
| 2 | XIX, XX, XXII | Developing agents. |

-continued

| Reference | Section | Subject Matter |
|---|---|---|
| 3 & 4 | XVIII, XIX, XX | |
| 3 & 4 | XIV | Scanning and digital processing procedures. |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-naphthalates)). Such supports are described in further detail in Research Disclosure (3), Section XV. The photographic elements may also contain a transparent magnetic recording layer such as a layer containing magnetic particles on the underside of a transparent support. Magnetic layers have been described in U.S. Pat. Nos. 4,279,945 and 4,302,523, and *Research Disclosure,* November 1992, Item No. 34390, which are incorporated herein by reference. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

The photographic elements may further contain image-modifying compounds such as "Developer Ihibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

Photographic elements of the present invention can be imagewise exposed using any of the known techniques, including those described in Research Disclosure (3). This typically involves exposure to light in the visible region of the spectrum, and typically such exposure is of a live image through a lens. The photographic elements can be incorporated into exposure structures intended for repeated use or exposure structures intended for limited use, variously referred to as single use cameras, lens with film, or photosensitive material package units. However, the color reversal photographic elements of the present invention may alternatively be exposed in an electronic film writer. Exposure in a film writer is an exposure to a stored image (such as a computer stored image) by means of light emitting devices (such as light controlled by light valves, CRT, laser, laser diode, or some other controlled light source).

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6" or "K-14". A "color reversal" process in this context is one employing a first developer treatment with a non-chromogenic developer (that is, a developer which will not imagewise produce color by reaction with other compounds in the film; sometimes referenced as a "black and white developer"). Black and white developing agents which may be used in the first development include dihydroxybenzenes or derivatives thereof, ascorbic acid or derivatives thereof, aminophenol and 3-pyrazolidone type developing agents. Such black and white developing agents are well known in the art, e.g., U.S. Pat. Nos. 5,187,050, 5,683,859, 5,702,875. Preferred non-chromogenic developers are hydroquinones (such as hydroquinone sulphonate). The non-chromogenic development is followed by fogging unexposed silver halide, usually either chemically or by exposure to light. Then the element is treated with a color developer which will produce color in an imagewise manner upon reaction with other compounds (couplers), which may be incorporated in the film or introduced during processing. A wide variety of different color reversal processes are well known in the art. For example, a single color developing step can be used when the coupling agents are incorporated in the photographic element or three separate color developing steps can be used in which coupling agents are included in the developing solutions.

Preferred color developing agents are p-phenylenediamines. Especially preferred are: 4-amino N,N-diethylaniline hydrochloride; 4-amino-3-methyl-N,N-diethylaniline hydrochloride; 4-amino-3-methyl-N-ethyl-N-(b-(methanesulfonamido)ethylaniline sesquisulfate hydrate; 4-amino-3-methyl-N-ethyl-N-(b-hydroxyethyl)aniline sulfate; 4-amino-3-b-(methanesulfonamido)ethyl-N,N-diethylaniline hydrochloride; and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in Research Disclosure (3). Standard commercial processing for reversal elements in accordance with the invention may preferably be utilized, including standard Kodak K-14 and Kodak E-6 processing.

The following examples are intended to illustrate, but not to limit the invention.

EXAMPLES

Example 1

A tabular, dump iodide, silver bromoiodide emulsion (Emulsion 1) was made in which iodide was added abruptly at about 60% of the make by dumping into the reaction vessel a silver iodide seed emulsion and then performing a silver overrun using the following components:

| | | |
|---|---|---|
| Silver Solution | A | 3.0M $AgNO_3$ |
| Nucl. Silver Solution | B | 0.8M $AgNO_3$ |
| Salt Solution | C | 2.985M NaBr; 0.015M KI |
| Salt Solution | D | 3.0M NaBr |
| Starting Kettle | E | 41.4 g NaBr, 18.4 g oxidized/de-ionized gel, 0.65 cc antifoamant, 4540.5 g water, |
| Ripener | F | 14.85 g $(NH4)_2SO4$, 168.24 g water |
| Gel Dump | G | 165 g oxidized/de-ionized gel, 0.5 cc antifoamant, |

-continued

| | | |
|---|---|---|
| | | 11.35 g NaBr, |
| Ir Dopant | H | 3.5 × 10−5M |
| AgI seed | I | 0.27 mole AgI |
| Finishing Gel | J | 216.5 g de-ionized gel, 7.5 g biocide, 1360 g water |
| Salt Dump | K | 115.8 g NaBr, 269.5 g water |

A mixture (E) containing NaBr, gel, antifoamant, and water is heated to 42.5 ° C. with stirring. Solution B is added to the kettle for 12.5 minutes at a rate of 35 mL/minute after which solution F is added. The pH is adjusted with NaOH to 10.0 and held for 5 minutes. The pH is adjusted to 5.5 with $HNO_3$ followed by addition of the gel dump (G) and a melt-hold of 5 minutes. Solution A and solution C are pumped into the kettle with accelerating flow for 43.6 minutes with the silver potential at 0 mV. Solution K is dumped into the kettle such that the silver potential is lowered to −46 mV. The temperature is ramped linearly to 65 ° C. over 13.5 minutes. AgI seed (I) is added and held for 2 minutes. The silver potential is adjusted to 50 mV over 24 minutes with solutions A and D. Solution H is added followed by introduction of solutions A and D, which addition continued for 9.33 minutes at 30 cc/minute. The kettle temperature is cooled to 40° C. and the emulsion concentrated by addition of the finishing gel (J). The resulting silver iodobromide (3 mole % iodide) tabular emulsion size is measured at 0.76 um ECD×0.089 um thickness.

Emulsion 1 Sensitization

Samples of the above emulsion are chemically sensitized in the order of addition with p-acetamidophenyl disulfide, sodium thiocyanate, 5-chloro-2-(2-[(5-chloro-3-(3-sulfopropyl)-2(3H)-benzoxazolylidene)methyl]-1-butenyl)-3-(3-sulfopropyl)-benzoxazolium inner salt triethylamine salt, 2-[2-[[3-(2-carboxyethyl)-2(3H)-benzothiazolylidene]methyl]-1-butenyl]-5-chloro-3-(3-sulfopropyl)-benzoxazolium inner salt N-(1-methylethyl)-2-propanamine salt and with sulfur and gold containing compounds at various temperatures as indicated below (see Table 1).

TABLE 1

| Sensitization | Sulfur Only Compound | Level (μmol) | Gold Containing Compound | Level (μmol) | S/Au | Finish Temperature (° C.) | Remarks |
|---|---|---|---|---|---|---|---|
| A | Sodium thiosulfate | 11.5 | Sodium aurous dithiosulfate | 8.80 | 3.31 | 52, 56, 60, 64, 68 | Comparison |
| B | SS-1a | 11.5 | Sodium aurous dithiosulfate | 8.80 | 3.31 | 52, 56, 60, 64,68 | Comparison |
| C | Sodium thiosulfate | 29.1 | S | 8.79 | 3.31 | 52, 56, 60, 64, 68 | Comparison |
| D | SS-1a | 29.1 | S | 8.79 | 3.31 | 52, 56, 60, 64, 68 | Invention |

After the sensitization step, KI and 4-hydroxy-6-methyl-1, 3, 3a, 7-tetraazaindene, sodium salt, monohydrate are added and the silver halide material coated on a polyester support at 70 mg/ft$^2$ of silver and 150 mg/ft$^2$ of 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-benzamide. The coatings are exposed by filtered daylight at 1/50 s with Wratten #9 filter and 0.5 neutral density on a stepped tablet and then processed with the E6 color reversal development process employing a 4 minute 1$^{st}$ development time. The reciprocal of the exposure needed to obtain a density point of 1.0 of the D log E curve is taken as a measure of the speed of the emulsion. The difference between the maximum and the minimum speed is tabulated as Δ speed.

TABLE 2

| | Speed observed at temperatures of | | | | | Speed Variability | |
|---|---|---|---|---|---|---|---|
| Sensitization | 52° C. | 56° C. | 60° C. | 64° C. | 68° C. | Δ Speed | Remarks |
| A | 116 | 119 | 124 | 126 | 121 | 10 | Sample 1 (comparison) |
| B | 119 | 123 | 126 | 125 | 124 | 7 | Sample 2 (comparison) |
| C | 112 | 122 | 124 | 124 | 127 | 15 | Sample 3 (comparison) |
| D | 125 | 125 | 126 | 127 | 128 | 3 | Sample 4 (invention) |

Data in Table 2 shows that use of the conventional combination of sensitizers, sodium thiosulfate and sodium aurous dithiosulfate (Sensitization A, Sample 1) in sensitizing a AgBrI (dump iodide) emulsion at temperatures ranging from 52 to 68° C. leads to a speed variability (Δ speed) of 10. The combination of SS-1a and the conventional gold sensitizer, sodium aurous dithiosulfate (Sensitization B, Sample 2)

gives a somewhat lower variability (Δ speed of 7). The combination of the conventional sulfur sensitizer, sodium thiosulfate and the gold sensitizer S (Sensitization C, Sample 3) gives the worse speed variability (Δ speed of 15). When emulsions are sensitized with the inventive combination compounds SS-1a and S (Sensitization D, Sample 4) under varying temperatures, the least amount of speed variability (Δ speed of 3) is observed.

Example 2

A tabular silver bromoiodide emulsion having uniform iodide distribution (Emulsion 2) was made using the following components:

| | | |
|---|---|---|
| Silver solution: | A | 2.5 M $AgNO_3$ |
| Salt solution: | B | 2.4 M NaBr, 0.10 M KI |
| Starting solution (kettle) | C | 5.17 g oxidized/de-ionized gel, 1.52 g antifoamant, 8.04 g NaBr, 7.8 kg water |
| Ripener: | D | 9.56 g thioether |
| Gel dump: | E | 159 g oxidized/de-ionized gel, 0.15 g antifoamant, 0.48 g NaBr, 1500 g water |

-continued

| | | |
|---|---|---|
| Ru dopant: | F | $4.9 \times 10^{-3}$ M |
| Se dopant: | G | $1.6 \times 10^{-4}$ M |
| Ir dopant: | H | $5.3 \times 10^{-5}$ M |
| Finish gel: | I | 268 g de-ionized gel, 6.41 g biocide, 208 g water |

Two solutions, $AgNO_3$ (A) and NaBr/KI (B), are added over 1.18 minutes at constant flow to a reaction vessel containing ripener (D), oxidized/de-ionized gel, antifoamant, NaBr and water (C) at 35° C. After adding gelatin (E), the $AgNO_3$ (A) and NaBr/KI (B) solutions are added with accelerated flow rate for 45 minutes. The $AgNO_3$ (A) and NaBr/KI (B) solutions are then added at constant flow rate while solutions containing Ru (F) and Se (G) are added. The silver potential is raised to 60 mV and a solution containing Ir (H) is added. Final Agrowth with $AgNO_3$ (A) and NaBr/KI (B) is carried out for 9 minutes at constant flow rate. After washing and concentrating the resulting emulsion, the finish gel (I) containing de-ionized gel, a biocide and water is added. The resulting tabular silver iodobromide emulsion (4 mole % iodide) grain size is measured at 0.34 μm ECD×0.073 μm thickness.

Emulsion 2 sensitization

Samples of the above emulsion are chemically sensitized in the order of addition with p-acetamidophenyl disulfide, sodium thiocyanate, 5-chloro-2-(2-[(5-chloro-3-(3-sulfopropyl)-2(3H)-benzoxazolylidene)methyl]-1-butenyl)-3-(3-sulfopropyl)-benzoxazolium inner salt triethylamine salt, 2-[2-[[3-(2-carboxyethyl)-2(3H)-benzothiazolylidene]methyl]-1-butenyl]-5-chloro-3-(3-sulfopropyl)-benzoxazolium inner salt N-(1-methylethyl)-2-propanamine salt, 3-(2-methylsulfamoylethyl)-benzothiazolium tetrafluoroborate and with sulfur and gold containing compounds at temperatures indicated below (see Table 3).

TABLE 3

| Sensitization | Sulfur Only Compound | Level (μmol) | Gold Containing Compound | Level (μmol) | S/Au | Finish Temperature (° C.) | Remarks |
|---|---|---|---|---|---|---|---|
| A | Sodium thiosulfate | 31.4 | Sodium aurous dithiosulfate | 22.6 | 3.39 | 52, 56, 60, 64, 68 | Comparison |
| B | SS-1a | 31.4 | Sodium aurous dithiosulfate | 22.6 | 3.39 | 52, 56, 60, 64, 68 | Comparison |
| C | Sodium thiosulfate | 76.5 | S | 22.6 | 3.39 | 52, 56, 60, 64, 68 | Comparison |
| D | SS-1a | 76.5 | S | 22.6 | 3.39 | 52, 56, 60, 64, 68 | Invention |

After the sensitization step, KI is added. This run iodide emulsion is similarly coated, exposed and processed as for Example 1.

TABLE 4

| | Speed observed at temperatures of | | | | | Speed Variability | |
|---|---|---|---|---|---|---|---|
| Finish | 52° C. | 56° C. | 60° C. | 64° C. | 68° C. | Δ Speed | Remarks |
| A | 61 | 68 | 72 | 73 | 69 | 12 | Sample 5 (comparison) |
| B | 59 | 68 | 71 | 71 | 69 | 12 | Sample 6 (comparison) |
| C | 49 | 56 | 63 | 62 | 66 | 17 | Sample 7 (comparison) |
| D | 64 | 66 | 68 | 69 | 68 | 5 | Sample 8 (invention) |

Data in Table 4 shows that use of the conventional combination of sensitizers, sodium thiosulfate and sodium aurous dithiosulfate (Sensitization A, Sample 5) in sensitizing a AgBrI (run iodide) emulsion at temperatures ranging from 52 to 68° C. leads to a speed variability (Δ speed) of 12. The combination of SS-1a and the conventional gold sensitizer, sodium aurous dithiosulfate (Sensitization B, Sample 6) gives the same variability (Δ speed of 12). The combination of the conventional sulfur sensitizer, sodium thiosulfate and the gold sensitizer S (Sensitization C, Sample 7) gives the worse speed variability (Δ speed of 17). When emulsions are sensitized with the inventive combination compounds SS-1a and S (Sensitization D, Sample 8) under varying temperatures, the least amount of speed variability (Δ speed of 5) is observed.

Example 3

A color reversal photographic element is prepared by coating the following layers in the following order onto a cellulose triacetate support subbed with gelatin using conventional coating techniques. In the composition of the layers, the amounts are given as g/m$^2$. Laydowns of silver halide are given relative to silver. Emulsion sizes are reported in diameter x thickness in microns. In accordance with the invention, the emulsions are chemically sensitized with an organomercapto Au(I) complex and a rapid sulfiding agent of formula SS-1.

| | |
|---|---|
| Layer 1: Antihalation Layer | |
| Black colloidal Silver | 0.25 |
| UV Dye UV-1 | 0.04 |
| UV Dye UV-2 | 0.06 |
| Dispersed in Solvent S-1 | 0.04 |
| Gelatin | 2.15 |
| Layer 2: Low speed Red Sensitive Layer | |
| Silver iodobromide emulsion | 0.36 |
| 1.06 μm by 0.092 μm, 4% bulk iodide emulsion spectrally sensitized with dyes SD-0 and SD-1 | (as silver) |
| Fine Grain Silver Bromide | 0.05 |
| 0.055 μm equivalent spherical diameter | (as silver) |
| Cyan Coupler C-1 | 0.10 |
| Dispersed in Solvent S-3 | 0.05 |
| Gelatin | 1.07 |
| Layer 3: Medium Speed Red Sensitive Layer | |
| Silver Iodobromide Emulsion | 0.43 |
| 0.85 μm by 0.090 μm, 4% bulk iodide, spectrally sensitized with dyes SD-0 and SD-1 | (as silver) |
| Fine Grain Silver Bromide | 0.06 |
| 0.055 μm equivalent spherical diameter | (as silver) |
| Cyan Coupler C-1 | 0.53 |
| Dispersed in Solvent S-3 | 0.20 |
| Gelatin | 0.94 |
| Layer 4: High Speed Red Sensitive Layer | |
| Silver Iodobromide Emulsion | 0.49 |
| 1.18 μm by 0.111 μm, 3% bulk iodide, spectrally sensitized with dyes SD-0 and SD-1 | (as silver) |
| Fine Grain Silver Iodobromide | 0.03 |
| 0.15 μm equivalent spherical diameter, 4.8% bulk iodide, spectrally sensitized with dyes SD-0 and SD-1 | |
| Fine Grain Silver Bromide | 0.065 |
| 0.055 μm equivalent spherical diameter | |
| Cyan Coupler C-1 | 0.77 |
| Dispersed in Solvent S-3 | 0.385 |
| Gelatin | 1.30 |
| Layer 5: First Interlayer | |
| Filter Dye FD-1 | 0.04 |
| SCV-1 | 0.16 |
| Dispersed in Solvent S-3 | 0.32 |
| Gelatin | 0.81 |
| Layer 6: Second Interlayer | |
| Carey Lea Silver | 0.002 |
| Gelatin | 0.81 |
| Layer 7: Low Speed Green Sensitive Layer | |
| Silver Iodobromide Emulsion | 0.45 |
| 0.62 μm by 0.064 μm, 4% bulk iodide, spectrally sensitized with dyes SD-4 and SD-5 | (as silver) |
| Fine Grain Silver Bromide | 0.10 |
| 0.055 μm equivalent spherical diameter | (as silver) |
| Magenta Coupler M-1 | 0.17 |
| Magenta Coupler M-2 | 0.07 |
| co-dispersed in Solvent S-2 | 0.12 |
| IRQ-1 | 0.014 |

-continued

| | |
|---|---|
| Dispersed with solvent S-4 | 0.028 |
| Gelatin | 1.10 |
| Layer 8: Medium Speed Green Sensitive Layer | |
| Silver Iodobromide Emulsion | 0.37 |
| 0.96 μm by 0.065 μm, 3% bulk iodide, spectrally sensitized with dyes SD-4 and SD-5 | (as silver) |
| Fine Grain Silver Bromide | 0.05 |
| 0.055 μm equivalent spherical diameter | (as silver) |
| Magenta Coupler M-1 | 0.33 |
| Magenta Coupler M-2 | 0.14 |
| Co-dispersed in Solvent S-2 | 0.235 |
| Gelatin | 0.87 |
| Layer 9: High Speed Green Sensitive Layer | |
| Silver Iodobromide Emulsion | 0.47 |
| 1.18 μm by 0.111 μm, 3% bulk iodide, spectrally sensitized with dyes SD-4 and SD-5 | (as silver) |
| Fine Grain Silver Iodobromide emulsion | 0.04 |
| 0.15 μm equivalent spherical diameter, 4.5% bulk, iodide spectrally sensitized with dyes SD-4 and SD-5 | (as silver) |
| Magenta Coupler M-1 | 0.62 |
| Magenta Coupler M-2 | 0.27 |
| Co-dispersed in Solvent S-2 | 0.445 |
| Gelatin | 1.53 |
| Layer 10: Third Interlayer | |
| Gelatin | 0.61 |
| Layer 11: Fourth Interlayer | |
| Carey Lea Silver | 0.07 |
| SCV-1 | 0.11 |
| Dispersed in solvent S-3 | 0.22 |
| Gelatin | 0.68 |
| Layer 12: Low Speed Blue Sensitive Layer | |
| Silver Iodobromide Emulsion | 0.27 |
| 1.47 μm by 0.135 μm, 3% bulk iodide, spectrally sensitized with dyes SD-6 and SD-7 | (as silver) |
| Silver Iodobromide Emulsion | 0.27 |
| 1.07 μm by 0.139 μm, 3% bulk iodide, spectrally sensitized with dyes SD-6 and SD-7 | (as silver) |
| Fine Grain Silver Bromide | 0.07 |
| 0.055 μm equivalent spherical diameter | (as silver) |
| Yellow Coupler YEL-1 | 1.27 |
| Dispersed in Solvent S-3 | 0.42 |
| Gelatin | 1.89 |
| Layer 13: High Speed Blue Sensitive Layer | |
| Silver Iodobromide Emulsion | 0.22 |
| 2.59 μm by 0.147 μm, 2% bulk iodide, spectrally sensitized with dyes SD-6 and SD-7 | (as silver) |
| Silver Iodobromide Emulsion | 0.22 |
| 1.86 μm by 0.133 μm, 2% bulk iodide, spectrally sensitized with dyes SD-6 and SD-7 | (as silver) |
| Yellow Coupler YEL-1 | 0.85 |
| Dispersed in Solvent S-3 | 0.28 |
| Gelatin | 1.13 |
| Layer 14: Fifth Interlayer: | |
| SCV-1 | 0.16 |
| Dispersed in solvent S-3 | 0.32 |
| Gelatin | 0.61 |
| Layer 15: First Overcoat: | |
| Silver iodobromide emulsion | 0.09 |
| 0.58 μm by 0.062 μm, 4% bulk iodide, spectrally sensitized with dyes SD-0 and SD-1 | (as silver) |
| Fine Grain Silver Bromide | 0.43 |
| 0.055 μm equivalent spherical diameter | (as silver) |
| Gelatin | 0.81 |
| Layer 16: Second Overcoat: | |
| UV Dye UV-4 | 0.41 |
| UV Dye UV-1 | 0.09 |
| Dispersed in Latex L-1 | 0.45 |
| Gelatin | 1.40 |

-continued
| Layer 17: Third Overcoat: | |
|---|---|
| Matte<br>1.7 μm spherical diameter | 0.02 |
| Hardener H-1 | 1.38% of total gel |
| Gelatin | 0.97 |
The components referenced above are shown below:
SCV-1:
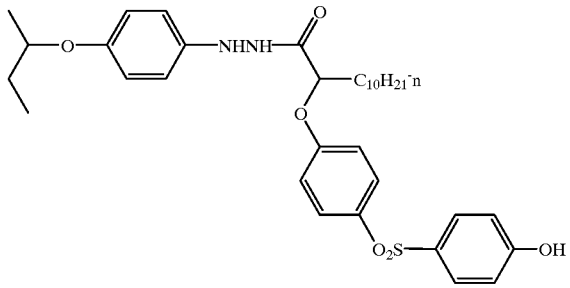
C-1:
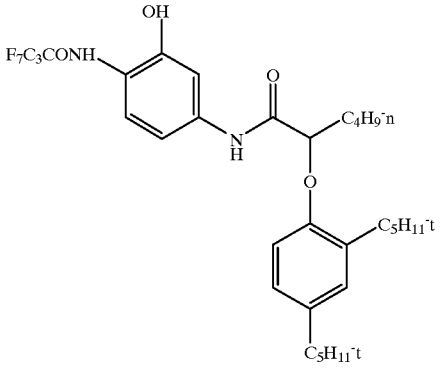
M-1:
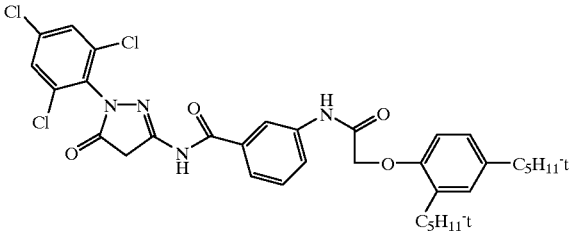
M-2:
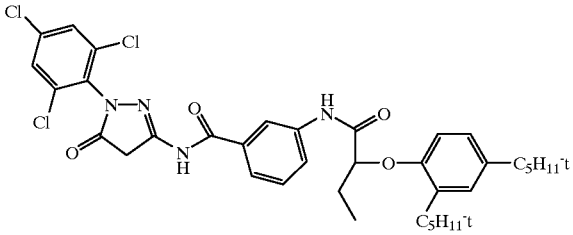
-continued
YEL-1:
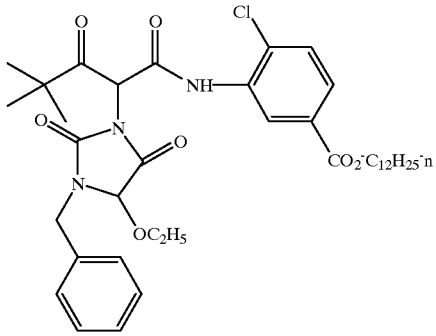
FD-1
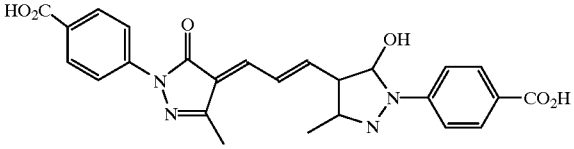
IRQ-1:
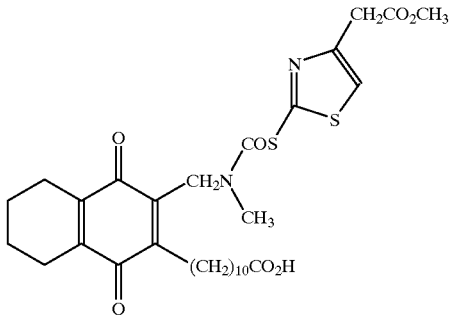
SD-0:
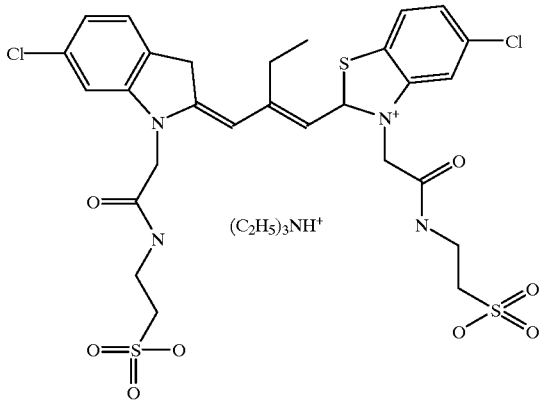

-continued

SD-1:

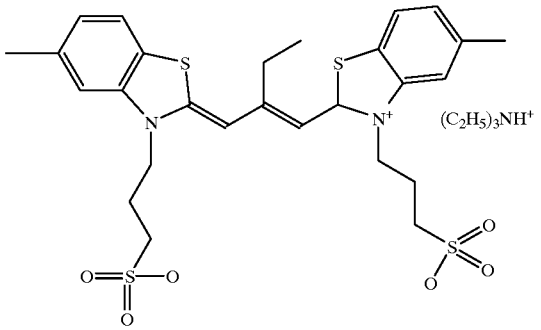

SD-4:

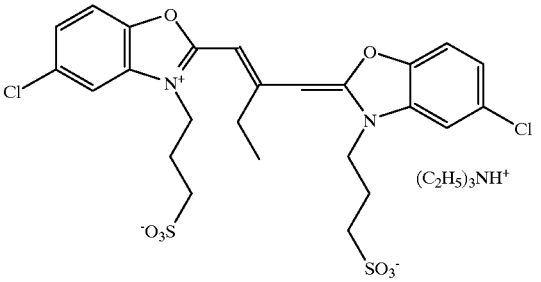

SD-5:

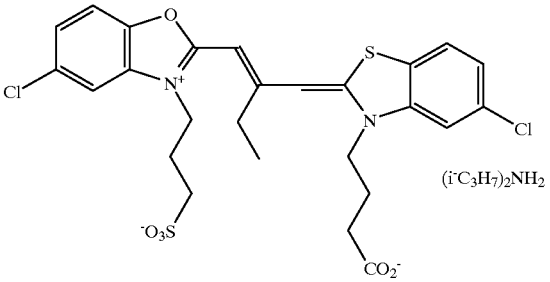

SD-6:

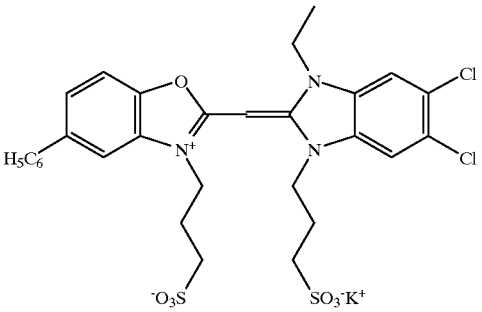

SD-7:

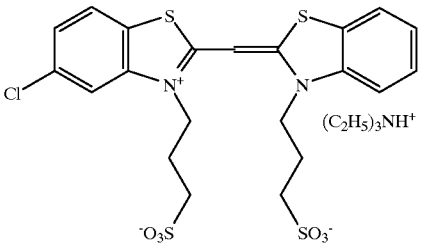

-continued

UV-1:

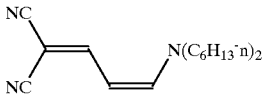

UV-2:

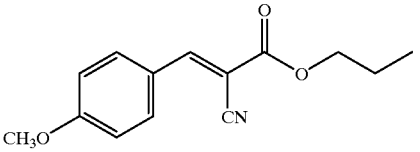

UV-4:

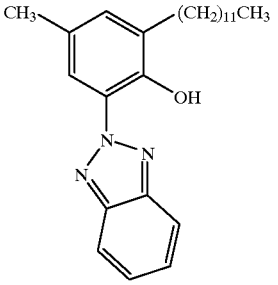

L-1:

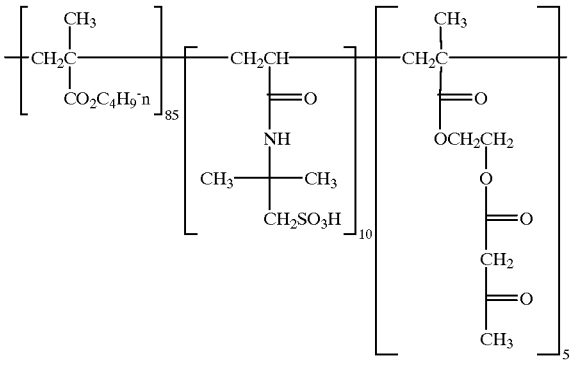

Hardener H-1:

1,1'-[methylenebis(sulfonyl)]bis-ethene

Solvent S-1:

1,4-Cyclohexylenedimethylene bis(2-ethylhexanoate)

Solvent S-2:

Phosphoric Acid, tris(methylphenyl) ester

Solvent S-3:

1,2-benzenedicarboxylic acid, dibutyl ester

Solvent S-4:

N,N-Diethyllauramide

Example 4

A color reversal element is prepared bearing the following layers from top to bottom in the following format by coating yellow, magenta, and cyan dye forming packs comprising silver iodobromide emulsion chemically sensitized with an organomercapto Au(I) complex and a rapid sulfiding agent of formula SS-1 on a support:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl)amino)

carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl) phenoxy)-acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'tetramethyl-5,5', 6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The invention has been described in detail with particular reference to certain preferred embodiments thereof, but it will be understood that variations and modifications can be effected within the spirit and scope of the invention.

What is claimed is:

1. A color reversal photographic element comprising a support and a silver halide emulsion layer comprising a silver halide emulsion chemically sensitized in the presence of (i) an organomercapto Au(I) complex having the formula $$[L—Au—L]M$$

wherein M is a cationic counter ion and each L is an organomercapto ligand which has antifogging, stabilizing or sensitizing properties, and (ii) a rapid sulfiding agent represented by structure SS-1

SS-1

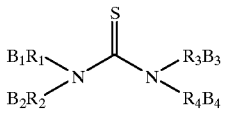

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain.

2. A photographic element according to claim 1, wherein the organomercapto Au(I) complex is of the formula $$[(M—SOL)_n—A—S—Au—S—A-(SOL-M)_n]M$$

wherein M is a cationic counterion, SOL is a solubilizing group, A is a substituted or unsubstituted divalent organic linking group, and n is 1 to 4.

3. A photographic element according to claim 2, wherein the organomercapto Au(I) complex is symmetrical.

4. A photographic element of claim 3 wherein A is a substituted or unsubstituted aliphatic, aromatic or heterocyclic group.

5. The photographic element of claim 4 wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium.

6. The photographic element of claim 4 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

7. The photographic element of claim 4 wherein A is a substituted or unsubstituted 5 to 6-membered heterocyclic ring with at least one atom selected from nitrogen.

8. The photographic element of claim 4 wherein SOL is a sulfato, sulfonato, sulfinato, phosphato, or carboxy group.

9. The photographic element of claim 3 wherein A-(SOL-M)$_n$ is

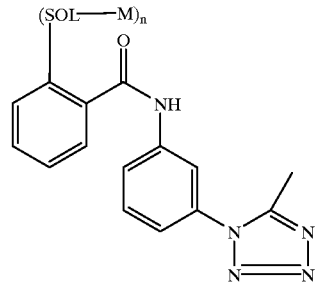

and wherein n is 1.

10. The photographic element of claim 9 wherein SOL is a sulfato, sulfonato, sulfinato, phosphate, or carboxy group and M is an alkali metal or an ammonium cation.

11. The photographic element of claim 2 wherein in structure SS-1 each of the $R_1$, $R_2$, $R_3$, and $R_4$ groups independently represents an alkylene group having 1 to 6 carbon atoms; and each of the $B_1$, $B_2$, $B_3$, and $B_4$ groups independently is hydrogen or represents a carboxylic, sulfinic, sulfonic, hydroxamic group; with the proviso that at least one of the $B_1R_1$ to $B_4R_4$ groups contains the nucleophilic group bonded to a urea nitrogen atom through a 1- or 2-membered chain.

12. The photographic element of claim 2, wherein the rapid sulfiding agent is of the structure SS-1a or SS-1b.

SS-1A

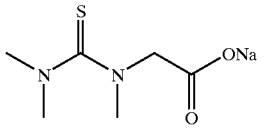

SS-1b

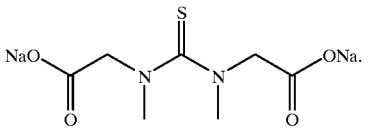

13. The photographic element of claim 1 wherein the silver halide emulsion comprises silver iodobromide grains with an iodide content of 2 to 12 mole %.

14. The photographic element of claim 13 wherein the silver iodobromide grains comprise tabular grains having an average aspect ratio of at least 2:1.

15. The photographic element of claim 1 wherein the amount of the organomercapto Au(I) complex contained in the silver halide emulsion is from 0.1 $\mu$mol to 500 $\mu$mol per mole of silver.

16. A photographic element of claim 1 comprising a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein the element is substantially free of masking couplers.

17. A photographic element according to claim 16, which exhibits a gamma between −1.5 and −4.0 when processed according to standard E-6 color reversal processing.

18. A method of preparing a color reversal photographic element comprising precipitating silver halide grains in an aqueous colloidal medium to form a silver halide emulsion, heating the emulsion, and adding to the emulsion, either before or during heating, (i) an organomercapto Au(I) complex having the formula $$[L—Au—L]M$$

wherein M is a cationic counter ion and each L is an organomercapto ligand which has antifogging, stabilizing or sensitizing properties, and (ii) a rapid sulfiding agent represented by structure SS-1

SS-1

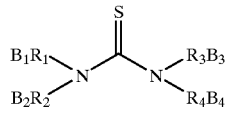

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain, and coating the silver halide emulsion on a support.

19. A method according to claim 18, wherein the organomercapto Au(I) complex is of the formula $$[(M—SOL)_b—A—S—Au—S—A\text{-}(SOL\text{-}M)_n]M$$

wherein M is a cationic counterion, SOL is a solubilizing group, A is a substituted or unsubstituted divalent organic linking group, and n is 1 to 4.

20. A method according to claim 19 wherein the organomercapto Au(I) complex is symmetrical, A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium; and SOL is a sulfato, sulfonato, sulfinato, phosphate, or carboxy group.

* * * * *